US005929813A

United States Patent [19]

Eggleston

[11] Patent Number: 5,929,813

[45] Date of Patent: Jul. 27, 1999

[54] ANTENNA FOR MOBILE COMMUNICATIONS DEVICE

[75] Inventor: Steve W Eggleston, San Diego, Calif.

[73] Assignee: Nokia Mobile Phones Limited, Esoo, Finland

[21] Appl. No.: 09/005,103

[22] Filed: Jan. 9, 1998

[51] Int. Cl.[6] ..... H01Q 1/38; H01Q 1/24

[52] U.S. Cl. ..... 343/700 MS; 343/702

[58] Field of Search ..... 343/702, 700 MS, 343/767, 795; H01Q 1/38, 1/24

[56] References Cited

U.S. PATENT DOCUMENTS 5,216,430 6/1993 Rahm et al. ..... 343/700 MS
5,680,144 10/1997 Sanad ..... 343/700 MS

*Primary Examiner*—Hoanganh Le
*Assistant Examiner*—Shih-Chao Chen
*Attorney, Agent, or Firm*—Brian T. Rivers

[57] ABSTRACT

A new category of mobile communications antenna is implemented in a single layer of conducting material. Wire-slot sections, including wire-tabs defining slots in the material, partially extend around the perimeter of at least one patch-tab section of the antenna. The perimeter of the at least one patch-tab section forms one edge of each slot, and the wire-tab of a wire-slot section forms a second edge of the slot. The wire-tabs of the wire-slot sections are separated from the patch-tab section by the slots and merge into the patch-tab section at a desired point. The length of each of the wire-slot sections may vary. A portion of each of a pair of the wire-tabs of the wire-slot sections functions as an input feed. The patch-tab section may be implemented as a single tab or as a plurality of tabs separated from one another by a slot. By varying the relative geometries of the patch-tab, wire-slots and tabs of the wire-slots, the electrical properties of the antenna, including the input impedance, can be adjusted.

18 Claims, 5 Drawing Sheets

ANTENNA FOR MOBILE COMMUNICATIONS DEVICE

FIELD OF THE INVENTION

This invention relates generally to antennas and, more particularly, to compact, lightweight antennas for mobile communications devices.

BACKGROUND OF THE INVENTION

As electronics and communications technology has advanced, mobile communications devices have become increasingly smaller in size. Mobile communications devices offering compact size and light weight, such as a cellular phone that can be carried in a pocket, have become commonplace. Concurrently, the increase in the sophistication of device performance and services offered has kept pace with the reduction in size and weight of these devices. It has been a general design goal to further reduce size and weight and increase performance at the same time.

Having compact size and light weight in combination with increased sophistication of performance as a design goal for a communications device presents challenges in all aspects of the design process. One area in which size and weight design goals may be counter to performance design goals is in the area of antenna design. Antenna design is based on manipulating the physical configuration of an antenna in order to adjust performance parameters. Parameters such as gain, specific absorption ratio (SAR), and input impedance may be adjusted by modifying various aspects of the physical configuration of an antenna. When constraints are externally set, such as when attempting to design an antenna for a mobile communications device having reduced size and weight, the design process becomes difficult.

The most common antenna used for mobile communications devices such as mobile phones is a quarter wave whip antenna which typically extends vertically from the top of the device and radiates in a donut-shaped pattern. The quarter wave whip antenna provides good performance relative to cost. Also, the quarter wave whip antenna can easily be designed having the standard input impedance of approximately 50 ohms for matching coupling to a mobile device.

As mobile communications devices decrease in size and weight, use of whip antennas may become increasingly inconvenient. Generally, the gain of an antenna is proportional to the effective cross-sectional area of the antenna. Decreasing the size of a whip antenna decreases the antenna gain. Alternative antenna designs suffer from the same shortcoming as size decreases. Additionally, smaller size, external antennas are more fragile and prone to breakage and, as devices become smaller and smaller, it may be desirable to design devices in which no external antenna is visible and protruding. An antenna internal to the device would be desirable in this case.

Because of the geometry and size of new mobile communications products, it is difficult to design an internal antenna that offers performance comparable to that offered by a whip antenna. It is even more difficult to design an external antenna that provides improved performance over a whip, while not increasing the cost of the antenna.

OBJECTS OF THE INVENTION

It is therefore an object of this invention to provide an improved antenna for a mobile communications device that overcomes the foregoing and other problems.

Another object and advantage of this invention is to provide an antenna for a mobile communications device that may be configured and hidden within the device, preventing the problems that occur when using external antennas.

It is a further object and advantage of this invention to provide an antenna for a mobile communications device that may be configured internally in the device, while providing comparable or improved performance as compared to conventional antennas used on mobile communications devices.

A further object and advantage of this invention is to provide an antenna for a mobile communications device that may be inexpensively manufactured and inexpensively configured internally within the device.

SUMMARY OF THE INVENTION

The present invention provides an antenna that utilizes a combined patch-tab and wire-slot configuration. The antenna is especially suited for use in a mobile communications device and may be configured and hidden internally within the device, while providing comparable or improved performance as compared to conventional antennas used on mobile communications devices. The antenna is also less expensive as compared to conventional antennas used on communications devices. The antenna is simple in design and may be inexpensively manufactured. The design of the antenna also allows the antenna to be inexpensively configured internally within the device during manufacture.

The antenna is implemented in a single layer of conducting material. Wire-slot sections, including wire-tabs defining slots in the materials, partially extend around the perimeter of at least one patch-tab section of the antenna. The perimeter of at least one patch-tab section forms one edge of each slot, and the wire-tab of a wire-slot section forms a second edge of the slot. The wire-tabs of the wire-slot sections are separated from the patch-tab section by the slots and merge into the patch-tab section at a desired point. The length of each of the wire-slot sections may vary. A portion of each of a pair of the wire-tabs of the wire-slot sections functions as an input feed. The patch-tab section may be implemented as a single tab or as a plurality of tabs separated from one another by a slot. By varying the relative geometries of the patch-tab, wire-slots and tabs of the wire-slots, the electrical properties of the antenna, including the input impedance, can be adjusted. The capacitance of the patch-tabs and wire-slots may be reduced in area to reduce the capacitance for adjusting the input impedance. The slots may be enlarged to improve antenna gain. The antenna allows a nonsymmetrical design that can be used to enable a conformal fit within a communications device.

The antenna is able to provide a higher gain than the conventional whip antenna that is commonly used in mobile communications devices. The antenna may be easily configured to provide the standard 50 ohm input impedance for mobile communications devices, such as a mobile phone.

In an embodiment of the invention, the antenna is implemented into a single layer of conducting material as a combined patch-tab and wire-slot configuration. The combined patch-tab and wire-slot configuration implements a closed loop design, with the wire-slot sections extending partially around the perimeter of the patch-tab section. The antenna has outer dimensions that allow it to be placed within a small space inside the cover of a mobile communications device. In the embodiment of the invention, the antenna is configured to be placed within the back upperside cover of a mobile phone, so that the antenna is completely internal to the mobile phone when the cover is assembled.

The layer of the antenna may be separated from a ground plane by using a spacer of appropriate dimensions and material, so that desired electrical properties are obtained. The ground plane may be placed directly on the spacer. Twin input feeds, one on each of the wire-tabs of the wire-slot sections, provide the input, with one feed connecting to the circuitry of the mobile phone and the other feed connecting to the ground plane when the antenna, spacer and ground plane are assembled. The antenna of the embodiment is implemented to have a 50 ohm input impedance at the input feeds.

BRIEF DESCRIPTION OF THE DRAWINGS

The above set forth and other features of the invention are made more apparent in the ensuing Detailed Description of the Invention when read in conjunction with the attached Drawings, wherein.

DETAILED DESCRIPTION OF THE INVENTION

Figure 1B:
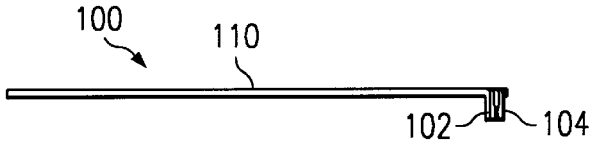
FIGS. 1A, 1B, and 1C are front, top, and right plan views, respectively, of an antenna constructed according to the teachings of the invention.
Figure 1A:
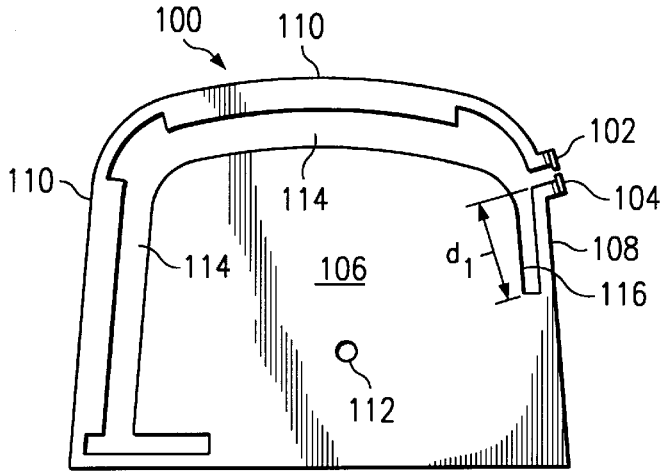
Figure 1C:
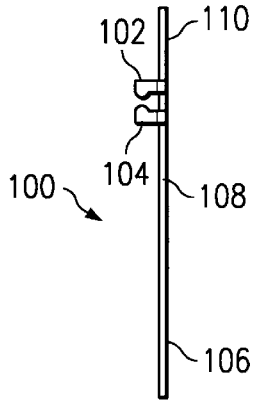

Referring now to FIGS. 1A, 1B, and 1C, therein are front, top, and right plan views, respectively, of an embodiment of an antenna constructed according to the teachings of the invention. Antenna 100 is constructed in a single sheet of conducting material and comprises a patch-tab section 106 and wire-slot sections formed from wire-tabs 110 and 108. Patch-tab section 106 is generally defined at the bottom and partially on the right by the contiguous area extending to the borders adjacent to the lower right-hand corner of antenna 100, and on the left and top by the slots 114 and 116 formed between wire-tabs 110 and 108, respectively, and patch-tab 106. Terminal 102 provides an input feed to wire-tab 110. Terminal 104 provides an input feed to wire-tab 108. The configuration of antenna 100 provides a patch-tab wire-slot combination antenna, the properties of which may be varied by changing the relative physical dimensions shown in FIG. 1. In the embodiment, antenna 100 is constructed out of copper. In other embodiments, it is also possible to construct antenna 100 out of any other suitable material, such as, for example, aluminum, zinc, iron or magnesium.

The configuration of antenna 100 allows the use of adjustments of the capacitances of wire-tabs 108 and 110 and patch-tab 106 to match the 50 ohm input impedance of a standard mobile telephone. Antenna 100 may be tuned by increasing or decreasing the length d1 of slot 116. Increasing the length lowers the resonant frequency and decreasing the length increases the resonant frequency. Finer tuning can be accomplished by adjusting the relative dimensions of wire-tabs 108 and 110, slot 114 and patch-tab 106. Antenna 100 may be configured to resonate at frequencies down to 750 MHz and may be configured to have a frequency range within the cellular frequency bands. For example, antenna 100 could have a frequency range of 824 MHz–894 MHz for cellular frequencies. The capacitances of wire-tabs 108 and 110 and patch-tab 106 also allow antenna 100 to be configured using a relatively small size, having a 50 ohm input impedance, that is suitable for mobile communication device applications. The nonsymmetrical geometry of the design allows a corner feed at terminals 102 and 104, and a shape providing a conformal fit into spaces suitable for the location of a mobile communication device internal antenna. A conventional loop antenna having the same parameters would be much larger.

The circular closed loop design causes magnetic reactive fields from opposite sides of the antenna to partially cancel in the near field. The slots 114 and 116 each have counter currents on opposite sides, which also result in partial cancellation of fields in the near field. The partial cancellation of fields in the near field produces a higher operational gain from a lower specific absorption ratio (SAR). The lower SAR is caused by the partial cancellation in the near fields.

Figure 4B:
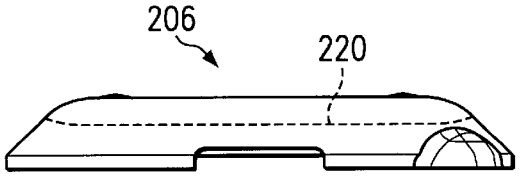
FIGS. 4A, 4B, and 4C are front, top, and right plan views, respectively, of the cover of the antenna assembly of FIG. 2.
Figure 4A:
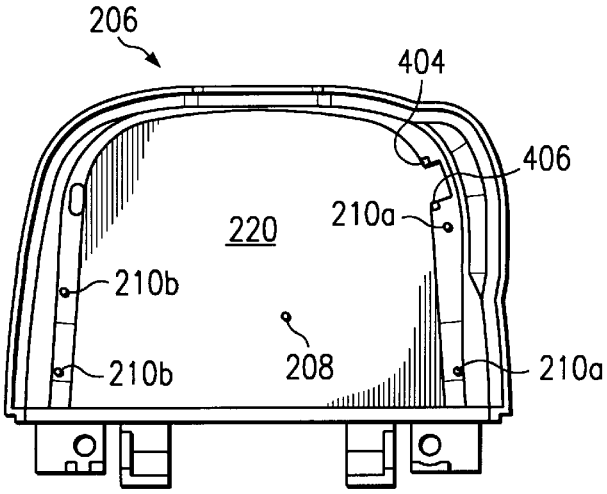
Figure 4C:
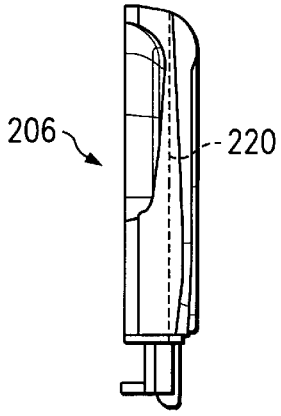
Figure 2:
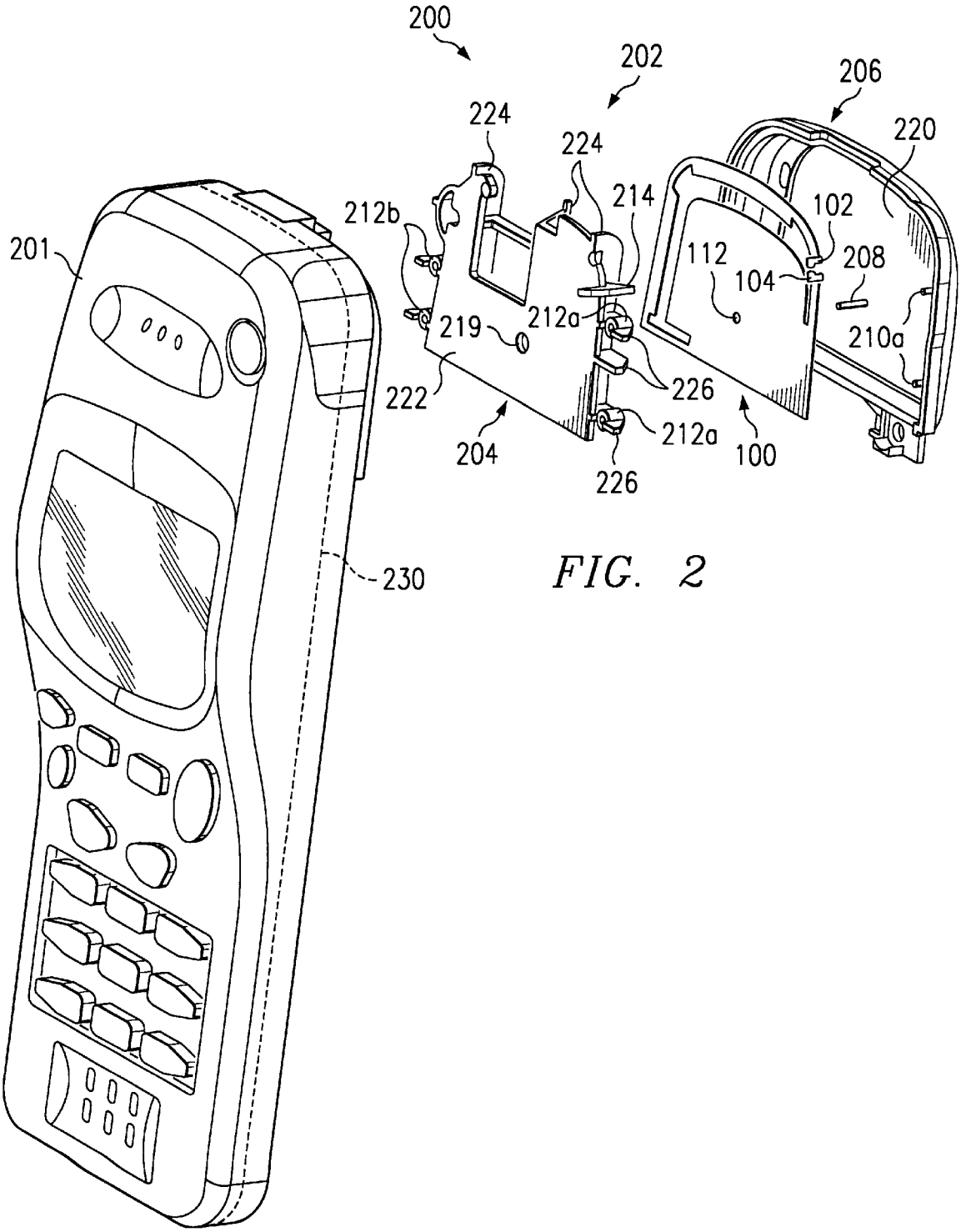
FIG. 2 is an exploded top-right front perspective view of a mobile telephone into which the antenna of FIG. 1 may be implemented.
Figure 3B:
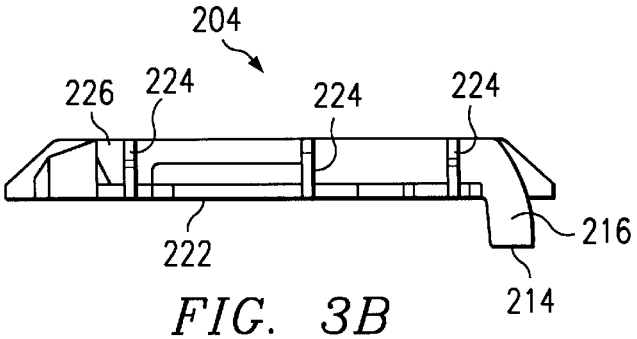
FIGS. 3A, 3B, 3C, and 3D are front, top, right, and rear plan views, respectively, of the ground plane-spacer portion of the antenna assembly of FIG. 2.
Figure 3A:
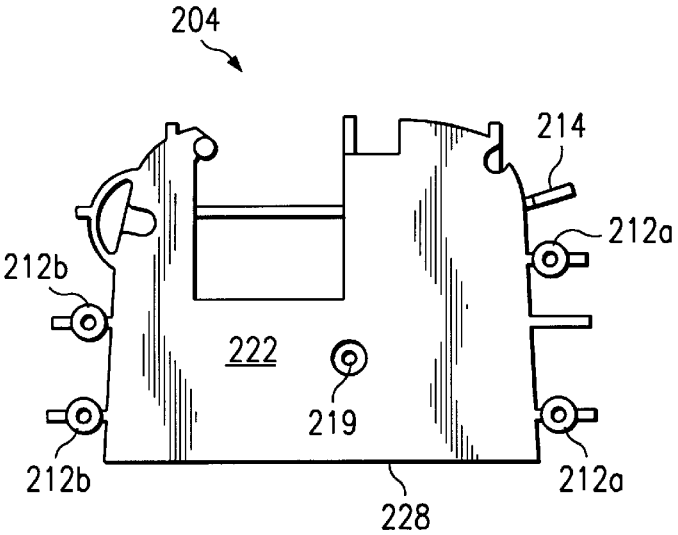
Figure 3C:
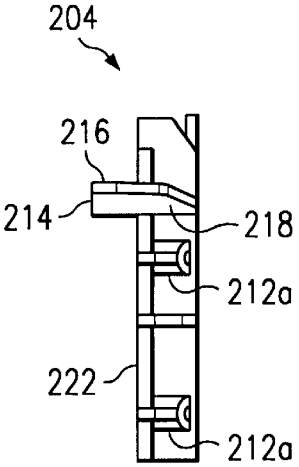
Figure 3D:
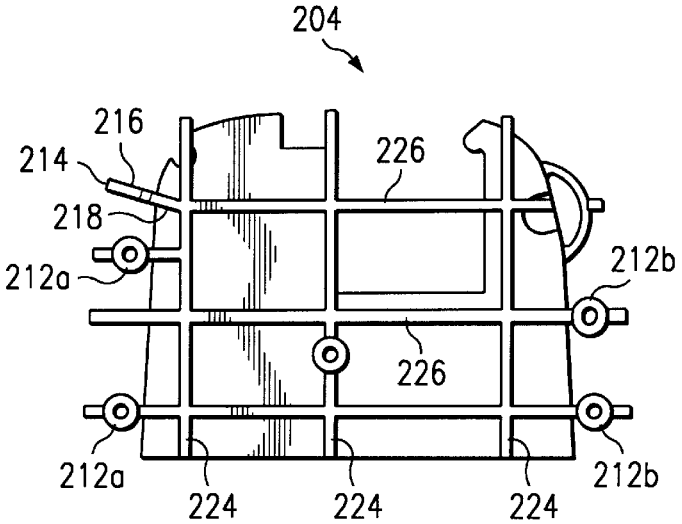

Referring now to FIG. 2, therein is an exploded top-right front perspective view of a mobile telephone into which the antenna of FIG. 1 may be implemented. Mobile telephone 200 comprises body 201 and antenna assembly 202. Antenna assembly 202 comprises antenna 100, ground plane-spacer 204, and cover 206. Mobile telephone 200 comprises a mounting board 230, shown by dotted line, for mounting antenna assembly 202. Antenna 100 is as described for FIG. 1. FIGS. 3A, 3B, 3C, and 3D are front, top, right and rear plan views, respectively, of the ground plane-spacer portion 204 of the antenna assembly 202 of FIG. 2. Ground plane-spacer 204 comprises mounting holes 218, 212*a* and 212*b*, antenna connector 214, spacing bars 224 and 226, and ground plane 222. Antenna connector 214 has a conducting surface 216 covering a first side of antenna connector 214. Conducting surface 216 is isolated and separate from ground plane 222. Antenna connector 214 also has a conducting surface 218 that covers a second side of conducting surface 218 on antenna connector 214 and that is electrically connected to ground plane 222. FIGS. 4A, 4B and 4C are front, top, and right plan views, respectively, of the cover 206 of the antenna assembly 202 of FIG. 2. Cover 206 comprises mounting pins 208, 210*a* and 210*b*, recess 220 and recess pins 404 and 406. In assembly, antenna 100 fits flush within recess 220 of cover 206. Pin 208 is inserted into hole 112 of antenna 100, and terminals 102 and 104 are retained within recess pins 404 and 406, respectively. Ground plane-spacer 204 is then placed into cover 206, with side pins 210*a* and side pins 210*b* of cover 206 engaging holes 212*a* and 212*b*, respectively, in spacer 204. Hole 218 of spacer 204 also engages pin 208 of cover 206. Terminals 102 and 104 of antenna 100 make contact and create an electrical connection with opposite conducting surfaces 216 and 218, respectively, of antenna connector 214. An electrical connection is then made from terminal 104 to ground plane 222 through conducting surface 218. Once assembled, the antenna assembly 202 can be inserted into the top rear section of mobile telephone 201, onto mounting board 230.

Figure 5:
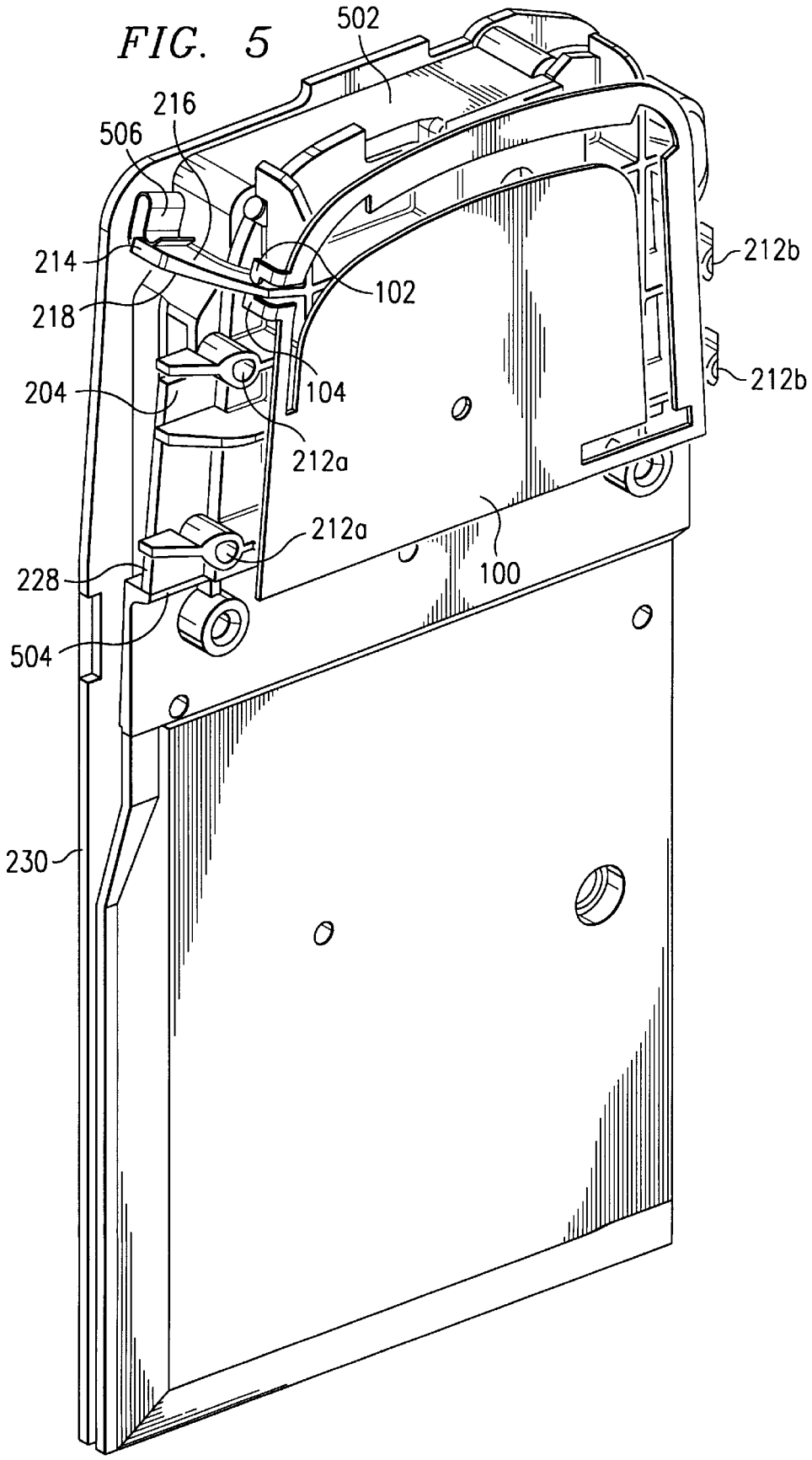
FIG. 5 is a top-left rear perspective view showing the mounting of the antenna and ground plane-spacer of the antenna assembly of FIG. 2 on a circuit board within the mobile telephone.

Referring now to FIG. 5, therein is a top-left rear perspective view showing the mounting of antenna 100 and ground plane-spacer 204 of antenna assembly 202 on mounting board 230. In FIG. 5, the mounting board 230 and antenna assembly 202 have been removed from within mobile telephone 201. Mounting board 230 comprises an electrical connector 506 and a first section 502 that is formed to engage ground plane-spacer 204, when antenna assembly 202 is placed on mounting board 230. Mounting board 230 also comprises a second section 504 that is formed so that the bottom edge 228 of ground plane-spacer 204 rests on second section 504, when antenna assembly 202 is placed on mounting board 230.

Electrical connection is made from terminal 104 of antenna 100 to ground plane 222, through conducting surface 218 of antenna connector 214, as described above. Electrical connection from terminal 102 of antenna 100 to mounting board 230 is made through conducting surface 216 to electrical connector 506. Electrical connector 506 may be connected to the appropriate circuitry for receiving a signal from antenna 100 for processing or for feeding a signal to antenna 100 for transmission.

By modifying the basic patch-tab and wire-slot configuration, other embodiments are also possible.

Figure 6:
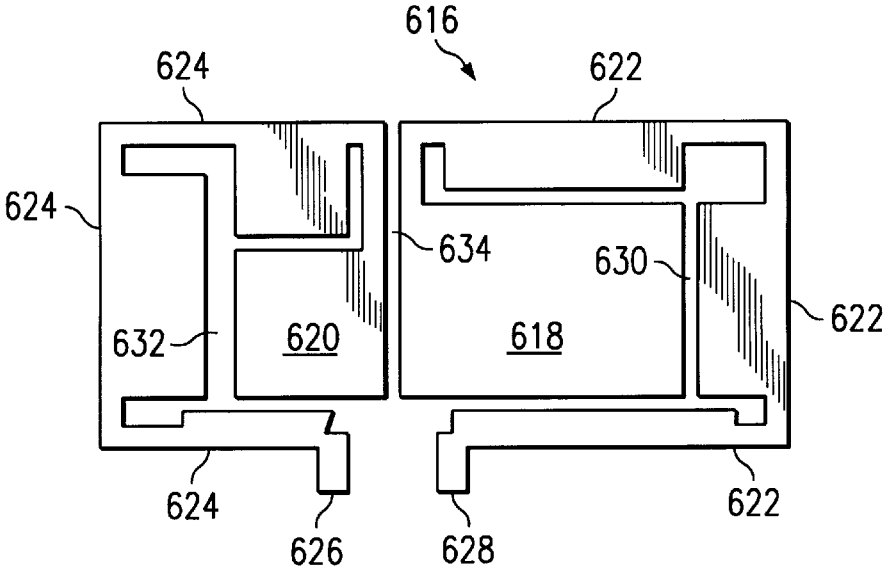
FIG. 6 is a front plan view of an alternative embodiment open antenna constructed according to the teachings of the invention.

Referring now to FIG. 6, therein a front plan view of alternative embodiment open antenna constructed according to the teachings of the invention. FIG. 6 shows a patch-tab and wire-slot antenna modified to perform as a patch-tab dipole antenna. Antenna 616 comprises two patch-tab sections 618 and 620. Patch-tab sections 618 and 620 form slots 630 and 632, respectively, with wire-tab sections 622 and 624, respectively. Terminals 626 and 628 provide signal feed from and to wire-tabs 624 and 622, respectively. The placement of slot 634 to divide patch-tabs 618 and 620 provides a voltage node so that antenna 616 functions as a patch-tab and wire-slot dipole antenna.

Figure 7:
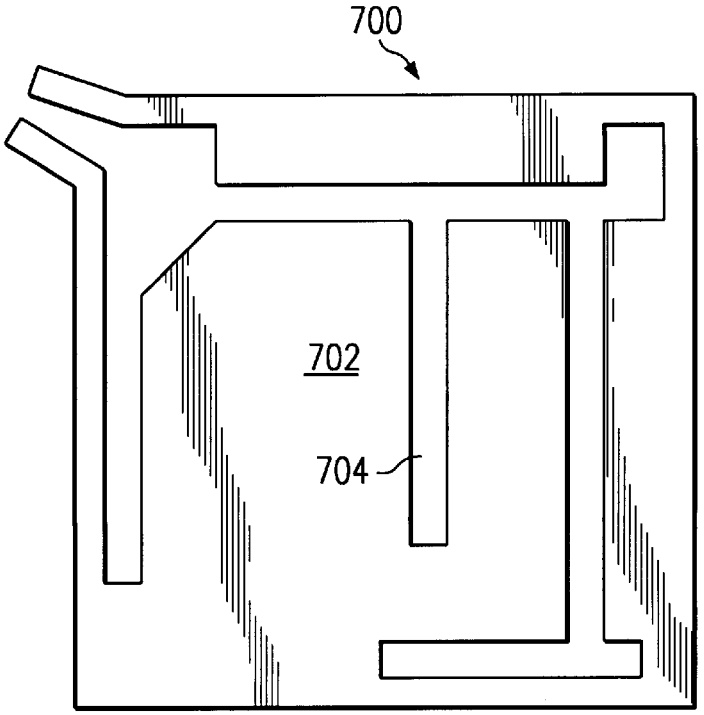
FIG. 7 is a front plan view of an alternative embodiment dual frequency antenna constructed according to the teachings of the invention.

Referring now to FIG. 7, therein is a front plan view of an alternative embodiment dual frequency antenna constructed according to the teachings of the invention. Antenna 700 is configured similarly to antenna 100 of FIG. 1. The addition of slot 704 in patch-tab section 702 introduces an additional voltage node in the antenna as compared to antenna 100. Antenna 700 is configured to resonate within a higher frequency range and a low frequency range. These ranges may be, for example, a high frequency range around the 2 GHz PCS frequencies and a low frequency range around the 900 MHz cellular frequency. Antenna 700 could then be used in a dual mode PCS/cellular mobile telephone.

Although described in the context of particular embodiments, it will be realized that a number of modifications to these teachings may occur to one skilled in the art. Thus, while the invention has been particularly shown and described with respect to specific embodiments thereof, it will be understood by those skilled in the art that changes in form and shape may be made therein without departing from the scope and spirit of the invention.

What is claimed is:

1. An antenna for use in a mobile communications device, said antenna comprising:

at least one patch-tab section each of said at least one patch-tab section formed of a separate sheet of conducting material and having a perimeter;

a plurality of wire-tab sections, each of said plurality of wire-tab sections having a first and a second end and at least a first and a second edge and formed contiguously with and merging into, at said first end, the sheet of conducting material of a selected patch-tab section of said at least one patch-tab section, and each of said plurality of wire-tab sections extending outward from and partially around the perimeter of said selected patch-tab section, defining a slot between the perimeter of said selected patch-tab section and said first edge, wherein said second at least one edge of each of said plurality of wire-tab sections defines a portion of an outer edge of said antenna; and a first and second terminal formed on the second end of a first and second wire-tab section, respectively, of said plurality of wire-tab sections, wherein said first and second terminals each provide a separate feed point to said antenna.

2. The antenna of claim 1, wherein said at least one patch-tab section comprises a single patch-tab section, and said plurality of wire-tab sections comprises a first wire-tab section and a second wire-tab section, and wherein the first edge of said first wire-tab section and the first edge of said second wire-tab section define a first and second slot, respectively, in said antenna.

3. The antenna of claim 2, wherein said antenna operates in a first frequency range and, further, wherein said patch-tab section includes a third slot, said third slot extending inward from the perimeter of said patch-tab section and allowing operation of said antenna in a second frequency range.

4. The antenna of claim 1, wherein said separate sheet of conducting material has a nonsymmetrical configuration.

5. An antenna for use in a mobile communications device, said antenna comprising:

a patch-tab section, said patch-tab section formed of a sheet of conducting material and comprising a first, second and third edge;

a first and second wire-tab section, each formed contiguous to said sheet of conducting material with said patch-tab section and extending outward from and partially around the perimeter of said patch-tab section, said first and second wire-tab sections defining a first and second slot, respectively, in said antenna, wherein said first wire-tab section includes at least one edge, and wherein said first slot is defined by said at least one edge of said first wire-tab section and said first, second and third edges of said patch-tab section; and a first terminal and a second terminal formed on said first wire-tab section and said second wire-tab section, respectively.

6. The antenna of claim 5, wherein said second wire-tab section includes at least one edge and said perimeter of said patch-tab section further comprises a fourth edge, and said second slot is defined by said at least one edge of said second wire-tab section and said fourth edge of said patch-tab section, and wherein said first wire-tab section extends outward from said patch-tab section and around said first, second and third edges toward said fourth edge, and said second wire-tab section extends outward from said patch-tab section and along said fourth edge toward said third edge, so that said first and second terminals are provided adjacent to one another.

7. The antenna of claim 6, wherein said first and second terminals extend from said sheet of conducting material.

8. An antenna for use in a mobile communications device, wherein said antenna comprises conducting material in sheet form having a configuration comprising at least one patch-tab having an edge, and a plurality of wire-tabs, each of said plurality of wire-tabs having an edge, and a first and second end and each attached to a selected patch-tab of said at least one patch-tab at said first end, wherein the edge of each of said plurality of wire-tabs and the edge of said selected patch-tab of said at least one patch-tab form at least one of a plurality of slots in said antenna, and wherein said second end of each of said plurality of wire-tabs provides one of a plurality of feed points for said antenna.

9. The antenna of claim 8, wherein said configuration of said conducting material is nonsymmetrical.

10. The antenna of claim 9, wherein said second end of each of said plurality of wire-tabs includes a terminal.

11. The antenna of claim 10, wherein said plurality of wire-tabs comprises a first and second wire-tab and said antenna further comprises a ground plane, and further wherein said terminal included on said second end of said first wire-tab feeds a signal to and from said antenna, and said terminal included on said second end of said second wire-tab includes a terminal connected to said ground plane.

12. The antenna of claim 11, wherein each of said first and second wire-tabs extends partially around the edge of said selected at least one patch-tab section, and wherein the second ends of each of said first and second wire-tabs extend toward one another.

13. The antenna of claim 10, wherein said at least one patch-tab section comprises a first and second patch-tab and said plurality of wire-tabs comprises a first and second wire-tab, said first wire-tab forming a slot in combination with said first patch-tab and said second wire-tab forming a slot with said second patch-tab.

14. The antenna of claim 10, wherein said plurality of slots comprises a plurality of perimeter slots and wherein each said at least one patch-tab includes an inner slot, said inner slot extending into said at least one patch-tab from said edge of said at least one patch-tab.

15. A mobile phone, said mobile phone including an antenna, comprising conducting material in sheet form having a configuration comprising at least one patch-tab having an edge, and a plurality of wire-tabs, each of said plurality of wire-tabs having an edge and a first and second end and each attached to a selected patch-tab of said at least one patch-tab at said first end, wherein the edge of each of said plurality of wire-tabs and the edge of said selected patch-tab of said at least one patch-tab form at least one of a plurality of slots in said antenna, and wherein said second end of each of said plurality of wire-tabs provides one of a plurality of feed points for said antenna.

16. The mobile phone of claim 15, wherein said configuration of said conducting material is nonsymmetrical.

17. The mobile phone of claim 16, wherein said plurality of wire-tabs comprises a first and second wire-tab and said antenna further comprises a ground plane, and further wherein said second end of said first wire-tab includes a terminal for feeding a signal to and from said antenna, and said second end of said second wire-tab includes a terminal connected to said ground plane.

18. The mobile phone of claim 15, wherein said antenna is formed from a first contiguous sheet of conducting material, and wherein said antenna further includes a ground plane, said ground plane formed from a second contiguous sheet of conducting material, and wherein said first and second contiguous sheets of conducting material are positioned substantially parallel to one another within said mobile phone.

* * * * *